United States Patent [19]

Higuchi

[11] Patent Number: 4,707,690

[45] Date of Patent: Nov. 17, 1987

[54] VIDEO DISPLAY CONTROL METHOD AND APPARATUS HAVING VIDEO DATA STORAGE

[75] Inventor: Keizo Higuchi, Itami, Japan

[73] Assignee: Mitsubishi Denki Kabushiki Kaisha, Tokyo, Japan

[21] Appl. No.: 633,430

[22] Filed: Jul. 19, 1984

[30] Foreign Application Priority Data

Nov. 29, 1983 [JP] Japan ..... 58-227201

[51] Int. Cl.[4] ..... G09G 1/16

[52] U.S. Cl. ..... 340/750; 340/728; 340/721

[58] Field of Search ..... 340/750, 798, 800, 721, 340/749, 728

[56] References Cited

U.S. PATENT DOCUMENTS 3,816,824 6/1974 Thust et al. ..... 340/732
4,052,719 10/1977 Hutt et al. ..... 340/728
4,250,502 2/1981 Klauck ..... 340/800
4,429,306 1/1984 Macauley et al. ..... 340/735
4,555,763 11/1985 Dahme ..... 340/750

OTHER PUBLICATIONS

"A Microcomputer to Consumer Color TV Interface IC Chip", Ravinder K. Bhatnager, IEEE Transactions on Consumer Electronics, vol. CE-24, No. 3, Aug. 1976, pp. 381-390.

*Primary Examiner*—Marshall M. Curtis
*Attorney, Agent, or Firm*—Lowe Price LeBlanc Becker & Shur

[57] ABSTRACT

To improve data storage efficiency in a video display system having a video data memory (4) data for display is read out from the memory in a time shared manner. Addressing of the memory is controlled by an address multiplexer (7) in turn controlled by an address converting circuit (21) that generates, successively, memory addresses and memory addresses modified by an offset value.

8 Claims, 9 Drawing Figures

VIDEO DISPLAY CONTROL METHOD AND APPARATUS HAVING VIDEO DATA STORAGE

BACKGROUND OF THE INVENTION

1. Field of the Invention

The present invention relates to an improvement of a video display control method and apparatus and particularly relates to a video display control method and apparatus improved such that a video memory provided in the video display control apparatus can be utilized with high efficiency.

2. Description of the Prior Art

Conventional LSI or IC chips for control of a video display such as the one described in "A microcomputer to consumer color TV interface IC chip" by Ravinder K. Bhatnager, in IEEE Transaction on Consumer Electronics, Vol. CE-24, No. 3 Aug. 1978 pp 381–390, are well known in the art. The LSI described in this document comprises an improvement for making various kinds of display by a small number of memories for display. However, it has a disadvantage that it is impossible to output both character data and graphic data at the same time; only one of them can be selected.

As another conventional technology, a video display control apparatus as shown in FIG. 1 is known. Referring to FIG. 1, the reference numeral (1) denotes a CPU for controlling the whole apparatus, an IC chip "Z80" or "8088", for example, being used for this CPU; the numeral (2) denotes an address bus for transmitting an address provided from the CPU (1); the numeral (3) denotes a data bus for transmitting the data supplied to and from the CPU (1); the numeral (4) denotes a video memory for storing the data to be displayed; the numeral (5) denotes a video memory address counter for reading consecutively the data stored in the video memory (4) in synchronism with the raster of a display unit (17) (to be described later); the numeral (6) denotes a video memory address bus for transmitting a video memory address provided from the video memory address counter (5); the numeral (7) denotes an address multiplexer for making selection between the inputs of the address bus (2) and the video memory address bus (6), four IC chips "LS157" or "LS257", for example, being used for the address multiplexer; the numeral (8) denotes a data bus buffer for reading and changing the content of the video memory (4) according to the instruction from the CPU (1), IC chips "LS244" and "LS374" being used for this data bus buffer; the numeral (9) denotes a data bus for transmitting the data for display read out from the video memory (4) according to a video memory address; the numeral (10) denotes a video signal encoder for converting the data read out in parallel from the video memory (4) into a serial signal according to the timing of the raster of the display unit (17); the numeral (11) denotes a video signal provided from the video signal encoder (10); the numeral (12) denotes a clock signal generator; the numeral (13) denotes a clock signal for successively counting a count value of the video memory address counter (5); the numeral (14) denotes a clock signal for applying timing for converting the data to be displayed in parallel into a serial signal; the numeral (15) denotes a synchronizing signal generator for applying raster scanning timing to the display unit (17); the numeral (16) denotes a synchronizing signal; and the numeral (17) denotes a raster scan type display unit for displaying the content of the video memory (4).

The above stated video memory (4) comprises a video memory A (4*a*) and a video memory B (4*b*) for storing respectively the data to be displayed in parallel. A conventional type 4416 integrated circuit can be used for memories (4*a*) and (4*b*).

The above stated data bus buffer (8) comprises a data bus buffer A (8*a*) and a data bus buffer B (8*b*) corresponding respectively to the video memory A (4*a*) and the video memory B (4*b*) so that the CPU (1) may read the data from the video memory A (4*a*) or the video memory B (4*b*) or may change the data stored in the video memory A (4*a*) or the video memory B (4*b*).

Similarly, the above stated data bus (9) comprises a bus (9*a*) and a bus (9*b*) corresponding to the video memory A (4*a*) and the video memory B (4*b*) respectively so as to transmit the data read out from the video memory A (4*a*) and the video memory B (4*b*) according to a video memory address.

The above stated video signal encoder (10) comprises shift registers A (19*a*) and B (19*b*) for converting the display data transmitted through the display data buses (9*a*) and (9*b*) into serial signals and also comprises a logical sum circuit (20) for making addition of the two video signals provided from these shift registers A (19*a*) and B (19*b*).

FIG. 2 shows timing for reading data from the video memory A (4*a*) and the video memory B (4*b*).

FIG. 3 shows a logical address format of the video memory A (4*a*) and the video memory B (4*b*) viewed from the CPU (1).

FIG. 4 shows a logical address format of the video memory A (4*a*) and the video memory B (4*b*) viewed from the video memory address counter (5).

Referring now to FIGS. 2 to 4, the operation of a conventional video display control apparatus shown in FIG. 1 will be described.

The CPU (1) writes, in the respective addresses in the video memories A (4*a*) and B (4*b*) through the address bus (2) and the data bus (3), the screen data to be displayed on the raster scan type display unit (17) (the data being for example DA, DA+1, DA+2, . . . , DB, DB+1, DB+2, . . . ). The data thus written are shown in FIG. 3, where AP, AP+1, AP+2, . . . are addresses in the video memory A (4*a*) and AQ, AQ+1, AQ+2, . . . are addresses in the video memory B (4*b*). As shown in FIG. 3, the logical address format in the video memory A (4*a*) and the video memory B (4*b*) viewed from the CPU (1) is a serial format.

The data for display written in the video memory A (4*a*) and the video memory B (4*b*) are read out consecutively and cyclically by means of the video memory address counter (5). This reading operation is synchronous with the video memory addresses provided in synchronism with the rise of the clock signal (13), so that the data for display (for example, DA, DB) written in the video memory A (4*a*) and the video memory B (4*b*) are read out simultaneously as shown in FIG. 2. This is because the logical address format in the video memory A (4*a*) and the video memory B (4*b*) viewed from the video memory address counter (5) is as shown in FIG. 4 and the data to be displayed in parallel (for example, DA and DB, DA+1 and DB+1, etc.) are written in the same video memory address viewed from the video memory address counter (5) (for example, AX, AX+1, etc.).

The read out data for display are supplied to the shift register A (19*a*) and the shift register B (19*b*) of the video signal encoder (10) through the transmission buses (9*a*) and (9*b*). In the shift registers A (19*a*) and B (19*b*), the data for display are respectively parallel/series converted simultaneously. Then, the logical sum circuit (20) makes an addition of the data to provide an output as a video signal (11). The video signal (11) is displayed on the raster scan type display unit (17). More specifically, the contents in the video memory A (4*a*) and the video memory B (4*b*) are simultaneously displayed on the display unit (17).

As described above, in a conventional video display control apparatus, the data displayed simultaneously are written in the logical addresses of the video memory (4) arranged in parallel as viewed from the video memory address counter (5). As a result, in order to store data of a long bit length in the logical addresses, it is necessary to enlarge the logical addresses arranged in parallel and accordingly, the capacity of the video memory must be increased and the connections must be adapted for a long bit length of data (as shown by the data bus 9 in FIG. 1).

In addition, there is another disadvantage that if data of a short bit length is stored in the logical addresses of the video memory (4) arranged in parallel viewed from the video memory address counter (5), the video memory (4) contains a large area not utilized and therefore the video memory cannot be utilized economically and efficiently.

SUMMARY OF THE INVENTION

With a view to overcoming the above described disadvantageous points of a conventional apparatus, the present invention aims to provide a video display control apparatus capable of storing data in a video memory of a relatively small capacity having improved efficiency, in which for reading data of the video memory according to a video memory address provided from a video memory address counter, video memory addresses are supplied to the video memory in a time shared manner so that the data stored in the video memory are read out in a time shared manner, not simultaneously.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
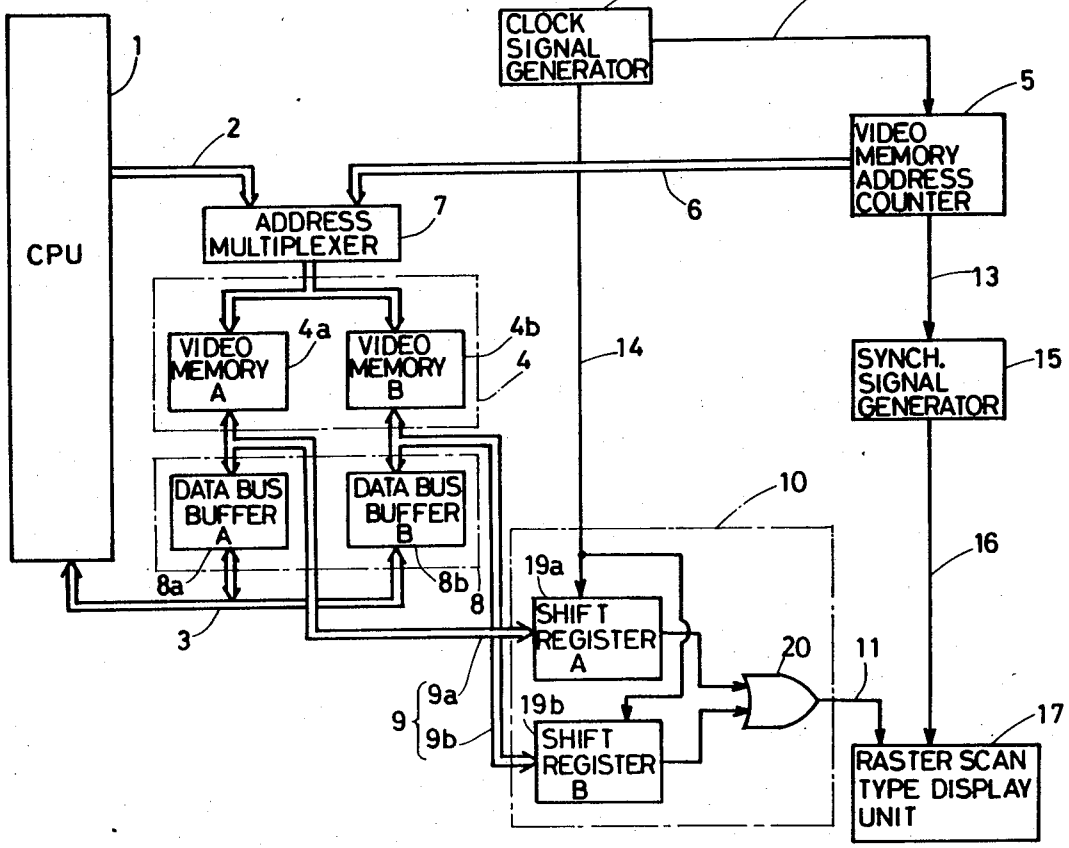
FIG. 1 PRIOR ART
FIG. 1 is a structural block diagram showing an example of a conventional video display control apparatus.
Figure 2:
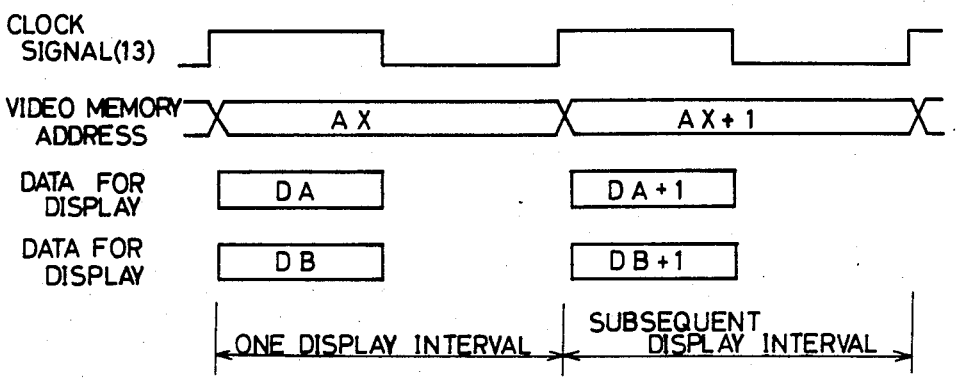
FIG 2 PRIOR ART
FIG. 2 is a timing chart showing a relation between a clock signal, video memory addresses and timing for reading data according to the video memory addresses in the conventional apparatus.
Figure 3:
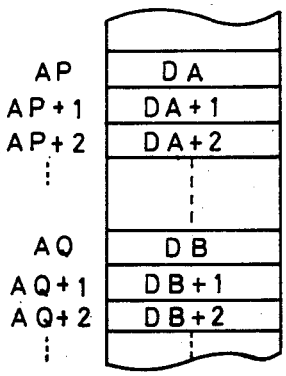
FIG 3 PRIOR ART
FIG. 3 is a diagram of a conventional logical address format of a video memory viewed from a CPU.
Figure 4:
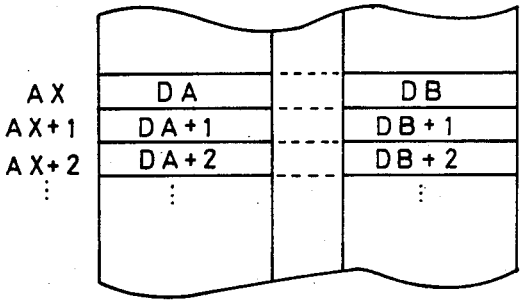
FIG 4 PRIOR ART
FIG. 4 is a diagram of a conventional logical address format of a video memory viewed from a video memory address counter.
Figure 5:
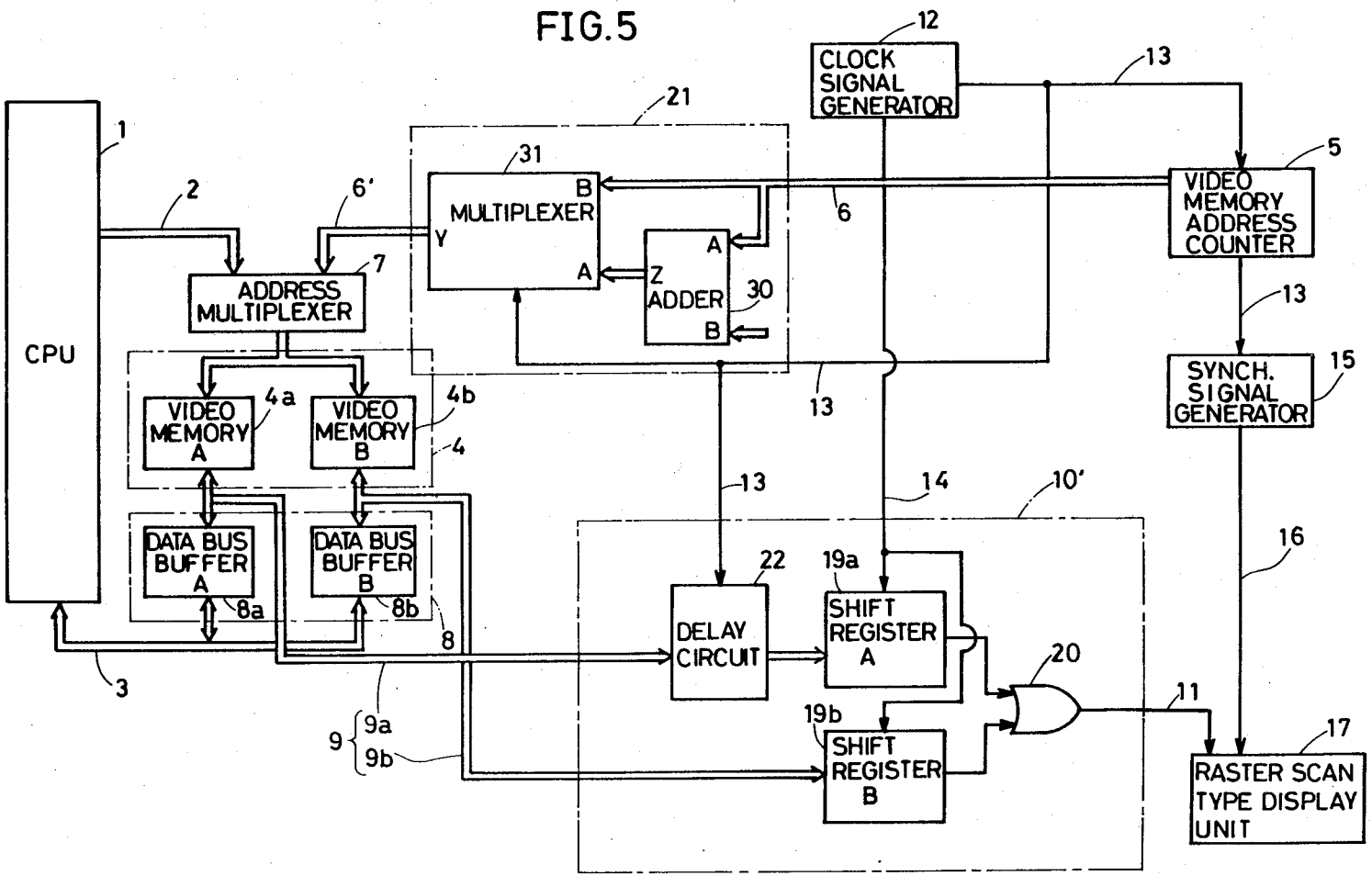
FIG. 5 is a structural block diagram showing an embodiment of a video display control apparatus in accordance with the present invention.

In the following, an embodiment of the present invention will be described in detail referring to FIG. 5. In FIG. 5, the reference characters identical to those in FIG. 1 denote components identical or similar to those in the conventional circuit in FIG. 1 and therefore the description thereof is omitted.

The reference character (21) denotes an address converting circuit for converting video memory addresses transmitted through a video memory address bus (6) into two kinds of video memory addresses, and this address converting circuit (21) comprises an adder (30) and a multiplexer (31). The converted video memory addresses are transmitted to an address multiplexer (7) through a video memory address bus (6'). In the address converting circuit (21), a clock signal (13) is supplied from a clock generator (12) to the multiplexer (31) for the purpose of applying the timing for converting the video memory addresses.

The reference character (10') denotes a video signal encoder, which is characterized by comprising a delay circuit (22) for delaying the phase of the read out data for display. To this delay circuit (22), a clock signal (13) is supplied for the purpose of applying the delay timing. For the above stated video signal encoder (10'), an edge input latch and a shift register, for example, are employed, for which IC chips "LS374" and "LS166", for example, are utilized.

Figure 6:
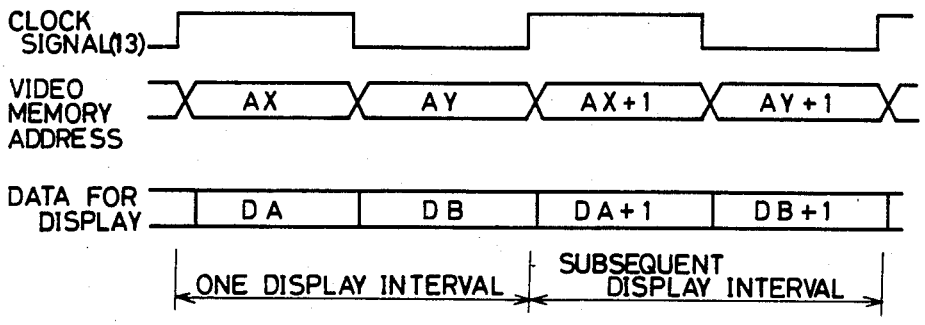
FIG. 6 is a timing chart showing timing between a clock signal, video memory addresses and data for display read out according to the video memory addresses in an embodiment of the present invention.

FIG. 6 shows a relation between the timing for generating video memory addresses and the timing for reading data to be displayed in an embodiment of the present invention.

Figure 7:
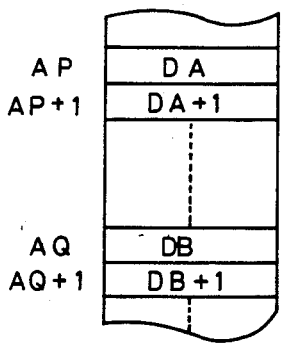
FIG. 7 is a diagram showing a logical address format of a video memory viewed from a CPU in an embodiment of the present invention.
Figure 8:
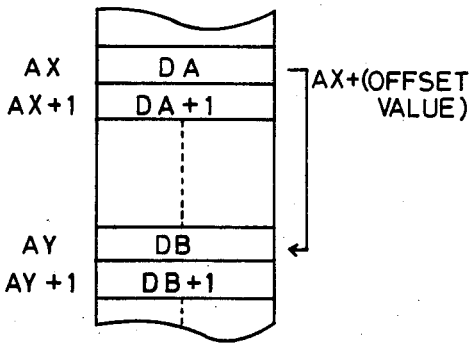
FIG. 8 is a diagram showing a logical address format of a video memory viewed from a video memory address counter in an embodiment of the present invention.

FIGS. 7 and 8 show respectively a logical address format of the video memory (4) viewed from the CPU (1) and a logical address format of the video memory (4) viewed from the video memory address counter (5).

Referring to these FIGS. 6 to 8, the operation of an embodiment of the present invention shown in FIG. 5 will be described in the following.

A video memory address (AX, for example) provided from the video memory address counter (5) is converted into two kinds of addresses (for example, AX and AY having a fixed offset value in relation to AX) by means of the address converting circuit (21). This will be more specifically explained in the following. Let us assume that a video memory address AX+N, for example, provided from the video memory address counter (5) is applied to a terminal B of the multiplexer (31) and to a terminal A of the adder (30) in the address converting circuit (21). At this time, an offset value M fixed in advance is applied to a terminal B of the adder (30). Accordingly, in the adder (30), these two inputs are added up and from a terminal Z thereof, AY+N obtained by offsetting AX+N is provided as output. This address is supplied to a terminal A of the multiplexer (31). In this multiplexer (31), an address AX+N is selected when the clock signal (13) is "H", and an address AY+N is selected when the clock signal (13) is "L". Thus, as stated above, a video memory address AX for example is converted into two kinds of addresses AX and AY in the address converting circuit (21).

The video memory addresses thus converted are supplied to the video memory (4) through the address multiplexer (7) and accordingly the data (for example, DA and DB) read out from the video memory (4) to be displayed in one display interval are read out not simultaneously but in succession as shown in FIG. 6. Therefore, in this embodiment, the logical address format of the video memory (4) viewed from the video memory address counter (5) is as shown in FIG. 8. More specifically, data to be displayed in one display interval is stored not in parallel in the same address, but in series in different addresses which are an arbitrary address (for example, AX) and an address (for example, AY) having a fixed offset value in relation to the arbitrary address. Thus, the logical address format of the video memory (4) is a serial format in the same manner as in case of a logical address format viewed from the CPU (1), which constitutes one of the characteristics of this embodiment.

Data for display read out in a time shared manner (for example, DA and DB) are parallel/series converted by means of the video signal encoder (10'). In this case, since the data (for example, DA and DB) are read out in a time shared manner so as to be inputted in succession, the delay circuit (22) functions to adjust the phases of the data DA and DB. More specifically, a signal of the data DA is delayed and shifted to comply with the same timing as in a signal of the data DB, whereby a video signal 11 (which is a signal equivalent to the video signal 11 shown in FIG. 1) can be obtained.

Although in the foregoing, a case of two sets of data (for example, DA and DB) to be displayed simultaneously in one display interval was described, it is the substantially same with a case where three or more than three sets of data are to be displayed simultaneously in one display interval.

Figure 9:
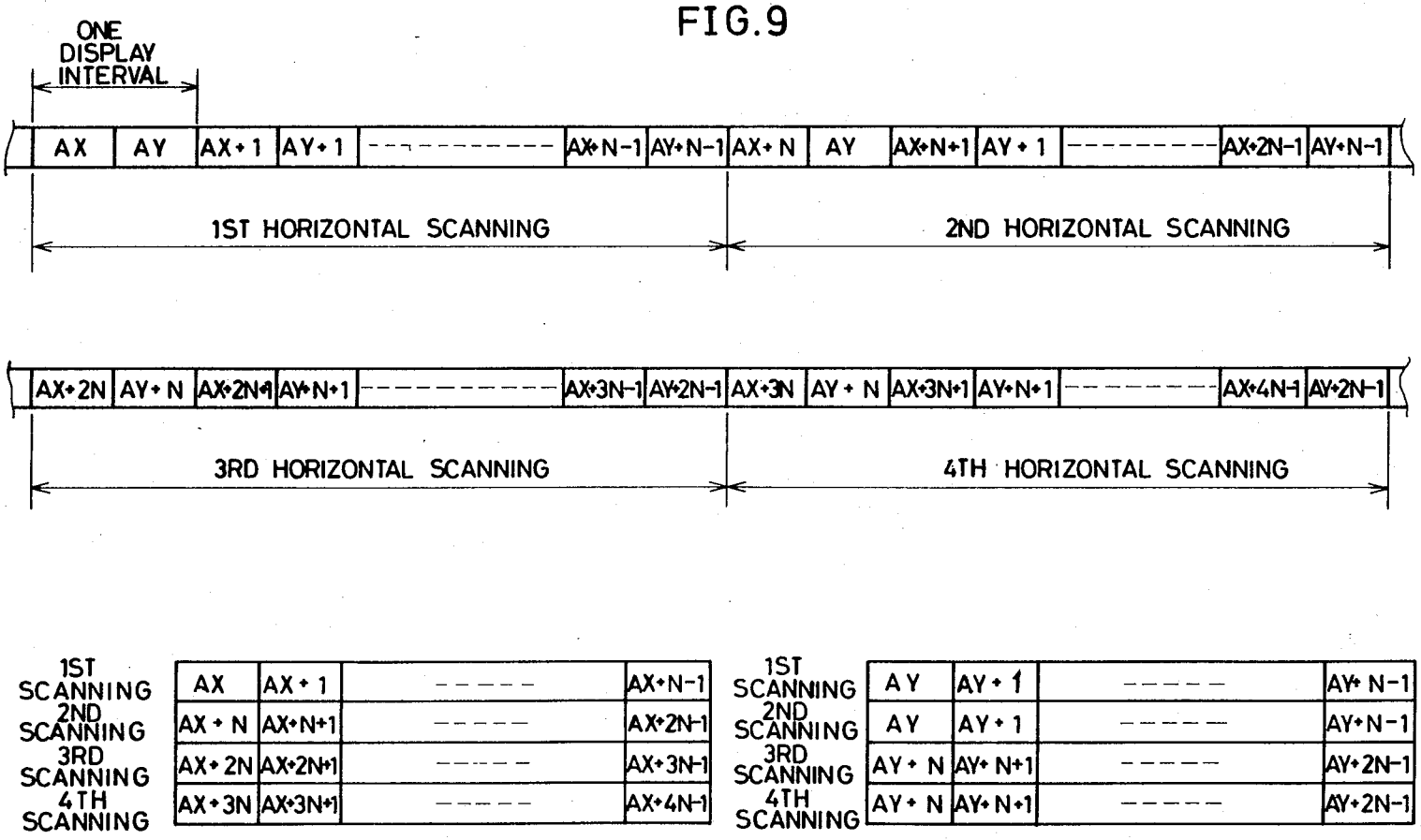
FIG. 9 is a diagram showing other combination of video memory addresses and data read out according to the addresses.

In addition, although in the above embodiment, a case of an arbitrary address AX and an address AY having a fixed offset value (having certain regularity) in relation to the arbitrary address was described, it will be also made possible to display simultaneously bit map data and character data by changing the regularity between the addresses AX and AY. FIG. 9 shows such an example. Referring to FIG. 9, in case where the lower left portion in FIG. 9 indicates an address AX relation (for example, bit map data) and the lower right portion indicates an address AY relation (for example, character data), the data are displayed as shown in the upper portion in FIG. 9.

As described above, according to the present invention, video memory addresses are outputted in a time shared manner so that data for display are read out from a video memory in a time shared manner. As a result, efficiency of a video memory can be improved and a video display control apparatus having a reduced area of connection in the vicinity of a video memory can be obtained.

In addition, with a video memory having a relatively small capacity as compared with conventional apparatus, a plurality of data can be displayed simultaneously on the screen in the same manner as in conventional apparatus.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A video display control apparatus, comprising:

video data memory means for storing a plurality of pieces of video data to be displayed on the screen of a raster scan type display unit, said display unit providing a display formed of repetitive raster scan operations, clock signal generating means for generating a clock signal, video memory address signal generating means coupled to said clock signal generating means for generating a video address signal for reading, consecutively in the scanning order of said screen, said plurality of pieces of video data stored in said video data memory means, and video memory address converting means coupled to said video memory address signal generating means and said clock signal generating means for converting said video memory address signal from said video memory address signal generating means for reading, from said video data memory means in a time shared manner, said plurality of pieces of video data to be displayed in the interval of each said raster scan operation, said video memory address signal generating means comprising:

adder means coupled to said video memory address signal generating means for adding a predetermined offset address signal corresponding to a dimension along a scan line greater than one pixel to said video memory address signal for providing an offset address added video memory address signal, and multiplexer means coupled to said clock signal generating means for switching said memory address signal obtained from said video memory address signal generating means and said offset address added video memory address signal for continuously providing said address signal and offset added address signal alternately in a time shared manner synchronously with scanning of the screen of said display unit.

2. A video display control apparatus in accordance with claim 1, which further comprises video memory encoding means responsive to said clock signal generating means for encoding said plurality of pieces of video data read from said video data memory means in accordance with said video memory address signal to be synchronized with said raster scan operation of said display unit.

3. A video display control apparatus in accordance with claim 2, wherein said video memory encoding means comprises delay means for selectively applying a delay time to a plurality of pieces of time shared data to be displayed in said interval for correcting a delay of time caused by said time shared manner for displaying said plurality of pieces of data simultaneously on said screen.

4. A video display control apparatus in accordance with claim 3, which further comprises synchronizing signal generating means coupled to said clock signal generating means for generating a synchronizing signal to said display unit for making a repetition of raster scan operations.

5. A video display control apparatus in accordance with claim 4, which further comprises a central processing unit coupled to said video data memory means for renewing said video data stored in said video data memory means.

6. A video display control apparatus in accordance with claim 5, which further comprises address multiplexer means coupled to said central processing unit and said video memory address converting means for selectively supplying the output of either of said central processing unit and said video memory address converting means to said video data storage means, and data buffer means coupled to said central processing unit and said video data storage means for temporarily storing said video data to be supplied from said central processing unit to said video data storage means until said video data is stored in said video data storage means.

7. A method of controlling a video display, comprising the steps of:

storing in a video data memory means a plurality of pieces of video data to be displayed on the screen of a raster scan type display unit, generating a clock signal, synchronously with the clock signal generating a video address signal for reading, consecutively in a scanning order of the screen, the plurality of pieces of video data stored in the video data memory means, and converting the video address signals for reading, from the video data memory means in a time shared manner, the plurality of pieces of video data to be displayed in a scanning interval of the screen, including adding to the memory address signal a predetermined offset address signal corresponding to a dimension along a scan line greater than one pixel to attain an offset address added video memory address signal, and continuously addressing the video memory means using alternately the video memory address signal and offset address added video memory address signal in a time shared manner synchronized with raster scanning of the screen.

8. The method of claim 7, including delaying selectively a plurality of pieces of time shared data to correct for time delay caused by said time shared reading of data.

* * * * *